United States Patent [19]

Berlyn et al.

[11] 3,981,453

[45] Sept. 21, 1976

[54] METHOD FOR SEGREGATING BARK AND FOLIAGE FROM WOOD CHIPS AND TWIGS

[75] Inventors: Robin Wilfrid Berlyn, Montreal; James David Hutchinson, Dorval, both of Canada

[73] Assignee: Pulp and Paper Research Institute of Canada, Canada

[22] Filed: Nov. 29, 1974

[21] Appl. No.: 528,479

[30] Foreign Application Priority Data

Nov. 29, 1973 Canada ..... 186975

[52] U.S. Cl. ..... 241/21; 241/24; 241/28

[51] Int. Cl.[2] ..... B02C 23/38

[58] Field of Search ..... 241/14, 20, 21, 24, 241/28

[56] References Cited

UNITED STATES PATENTS

| | | | |
|---|---|---|---|
| 2,835,292 | 5/1958 | Berliner | 241/14 X |
| 2,973,152 | 2/1961 | Owens | 241/14 X |
| 3,337,139 | 8/1967 | Lloyd et al. | 241/20 |
| 3,367,495 | 2/1968 | Lea et al. | 241/20 X |
| 3,547,357 | 12/1970 | Johnson | 241/28 |
| 3,826,433 | 7/1974 | Erickson et al. | 241/14 |

*Primary Examiner*—Granville Y. Custer, Jr.
*Attorney, Agent, or Firm*—Millen, Raptes & White

[57] ABSTRACT

A method for segregating bark and/or foliage from wood chips and/or twigs in a mixture of such components is provided. The method includes three essential steps. The first step comprises conditioning a pile of such mixture by periodically sprinkling the pile with water during storage. The second step comprises vigorously agitating the conditioned mixture with sufficient water, and for sufficient time to break bonded bark from the wood chips and the twigs and to comminute the bark. The third step comprises wet screening the agitated mixture thereby separating effluent bark and foliage from the wood chips and/or twigs in the mixture. An additional step includes dewatering the effluent bark and foliage, thereby to recover screened out solids materials. This method can be operated successfully on either a batch or a continuous basis without any serious effect on the reduction of pulp quality.

17 Claims, 3 Drawing Figures

METHOD FOR SEGREGATING BARK AND FOLIAGE FROM WOOD CHIPS AND TWIGS

This invention relates to the preparation of wood for pulping. In particular, it is concerned with the segregation of contaminants, such as, for example, inner bark, outer bark, and foliage from mixtures of full tree chips. The method of the invention also provides for the detachment of any bark which is still bonded to a wood surface after chipping.

The productivity of present logging machines and systems is largely dependent on tree size, since trees are usually harvested and processed singly and in a manner which varies little from stem to stem. At the same time, the growing scarcity of woods labor is making it increasingly difficult to staff logging operations and meet production goals. These constraints are limiting factors in rationalizing logging operations and have stimulated interest in the development of new systems whose productivity is less dependent both on tree size and on the availability of a large labor force. One approach that has attracted considerable attention entails the conversion of full trees into chips at or near the stump. Bark and foliage would be removed from the chips either at a depot in the woods or at the mill itself.

A feasible method for segregating wood chips from bark and foliage would promote the benefits of higher utilization and improved handling procedures, and would facilitate multi-stem processing.

As regards higher utilization, the conversion of the bole, top and branches of each tree into chips would lead to a substantial increase in the utilization of the available fiber.

As regards improved handling procedures, it is known that chips can be handled more easily than roundwood. Chips are small and can be transported over long or short distances in a continuous manner using belts or conveyors or pneumatic or hydraulic pipelines.

As regards multi-stem processing, the rate at which trees are converted into chips is relatively unaffected by tree size, since several trees can be chipped at a time if the stems are small. Furthermore, it would not be necessary to remove tops and branches in advance of chipping. Thus, the principal restraints to increasing the productivity of logging systems would be removed. More important, the development of a multi-stem harvesting/processing system would favor the establishment of plantations near the mills. Within a relatively short period of time these stands would contain as much fibre/acre as the overmature stands now being logged in eastern Canada. Such a reduction in the crop rotation period is of great economic importance to the pulp and paper industry.

Several attempts have been made to develop a process for barking chips. One of them is known as the Vac-Sink process, described in U.S. Pat. No. 3,032,188 issued May 1, 1962 to A. L. Wesner. In the Vac-Sink process, wood chips and bark are subjected to a vacuum and are then expelled onto the surface of a water path. The wood chips tend to absorb water and sink, but the bark tends not to and thus tends to float. Sunken material is recovered with a drag chain, while that on the surface is skimmed off. This method suffers from two major deficiencies, namely: firstly, it is predicated on all of the bark breaking free from the wood during chipping, since no provision is made for detaching it during the process; and secondly, it is not sufficiently selective for various species of wood.

Another procedure is the Hosmer process described in Canadian Pat. No. 675,364 issued Dec. 3, 1963 to F. G. Blanchard and in U.S. Pat. No. 3,070,318 issued Dec. 25, 1962 to F. G. Blanchard. In this process, bark and chips are fed between the nips of several pairs of closely spaced driven rolls. The action of the rolls tends to break free any bark which is still bonded to the wood after chipping. Some bark then adheres to the surface of the rolls and is doctored off, while the more friable fragments are crumbled into smaller particles which are screened from the mix. This process suffers the deficiency that suitable bark contents are apparently achieved only at the expense of high wood losses. Furthermore, since the process includes no steps for segregating foliage from bark and chips, it is believed to be useful only with chipped bole wood and not with mixtures including foliage.

An interesting variation of the Hosmer process is described in Canadian Pat. No. 839,549 issued Apr. 21, 1970 to W. D. Lloyd but the procedure set out in this patent as well suffers from many of the deficiencies of the basic Hosmer process.

In another technique, developed by Bauer Brothers, a slow-speed impact breaker is used to break bark free from wood chips and reduce the mixture to a uniform size. The mix is then fed onto a double-deck shaker screen equipped with an air aspiration hood, where the bark is segregated from the mix. This technique suffers from the deficiencies of undue wood loss, and the difficulties of obtaining uniform chip size for both the screening and air-aspiration-separation steps.

In yet another process described in Canadian patent application Ser. No. 155,523 filed Nov. 3, 1972 now Canadian Pat. No. 958,673, issued Dec. 3, 1974, induced differences are exploited in the rebound characteristics of bark and wood to sort one from the other. However, before this can be done, the chipped mixture must be subjected to one or more of the following treatments to promote differences between the coefficient of restitution of wood and that of bark: (i) thawing, to ensure that the mixture is not frozen when it is processed; (ii) conditioning, to make the bark more vulnerable to the softening action of succeeding stages of the process; (iii) rolling, to break bonded bark free from wood and soften it by subjecting the mix to the compressive loads developed when chipped mixtures are fed between paired rollers; and (iv) agitating in water, to detach bark from wood and selectively soften it. After one, some, or all of the above treatments, outer bark and foliage are sorted from the mix with screens or trommels, while inner bark is segregated from the wood by exploiting differences in rebound characteristics.

When an unbarked tree or log is chipped, much, but not all of the bark is broken free. The amount which remains attached varies with the species of tree, the season of the year, and the state of the materials (frozen or thawed). In some cases, as much as 24 percent of the mixture may consist of wood chips with bark attached.

Accordingly, the mix will consist of discrete fragments of wood, inner bark, outer bark, and chips of wood with inner bark attached. If full trees are processed, the mixture will also contain twigs and foliage. Therefore, a process for sorting wood chips from the residue must make provision for breaking free any bark which is still bonded to wood. Once the wood is in a discrete form, bark and foliage must be segregated from it without undue loss or breakage of wood fiber, and without inducing any changes that would diminish pulp quality. A successful procedure for sorting bark and foliage from wood chips must satisfy at least the standards used in the manufacture of kraft pulp, i.e., residual bark content should not exceed 2 percent. Some wood losses and fibre damage would obviously be inevitable in such a process.

The sorting of one material from another depends on the successful exploitation of some difference(s) in their physical and/or chemical properties. Properties that are commonly used for this purpose include size, shape, color, specific gravity, aerodynamic behavior, various electrical phenomena, a variety of chemical affinities, and others. The properties of wood and bark overlap over much of their broad ranges and hence, the application of conventional sorting techniques leads to unacceptably high bark contents and/or excessive wood losses.

In one respect, however, bark is uniquely different from wood; namely, it is inherently weaker, and it is this factor which is exploited in the method of a broad aspect of this invention.

SUMMARY OF THE INVENTION

By one broad aspect of this invention, a method is provided for segregating bark and/or foliage from wood chips and/or twigs in a mixture containing these components. The method includes the following sequential steps: (i) conditioning, by storage in a pile to weaken the bark and its bond with the wood, (ii) vigorous agitation with a sufficient amount of water to allow the entire mixture to circulate and for a sufficient period, usually at least 5 minutes to detach bonded bark and to comminute bark into small particles, and (iii) wet screening to segregate effluent bark and other contaminants from the wood chips and/or twigs.

One advantage of the method according to a broad aspect of this invention is the simplicity and reliability of the method itself. The first stage, conditioning, only requires materials handling equipment, and in dry areas preferably some provision of watering down the chipped mixture during storage. The second and third stages of the process, agitation in water and wet screening, use equipment that is commercially available and which is in widespread use throughout the pulp and paper industry. Accordingly, operating and maintenance problems are minimal.

Another advantage of the method of an aspect of this invention is the fact that chip damage is limited to splitting along the grain, primarily among the larger chips and hence, there is less variation in chip size following processing than before.

Yet another advantage of the method according to an aspect of the present invention is that the present method, as compared to prior art methods, is particularly effective in processing twigs, branches annd foliage.

DETAILED DESCRIPTION OF ILLUSTRATED EMBODIMENTS

Figures 1, 2, 3:
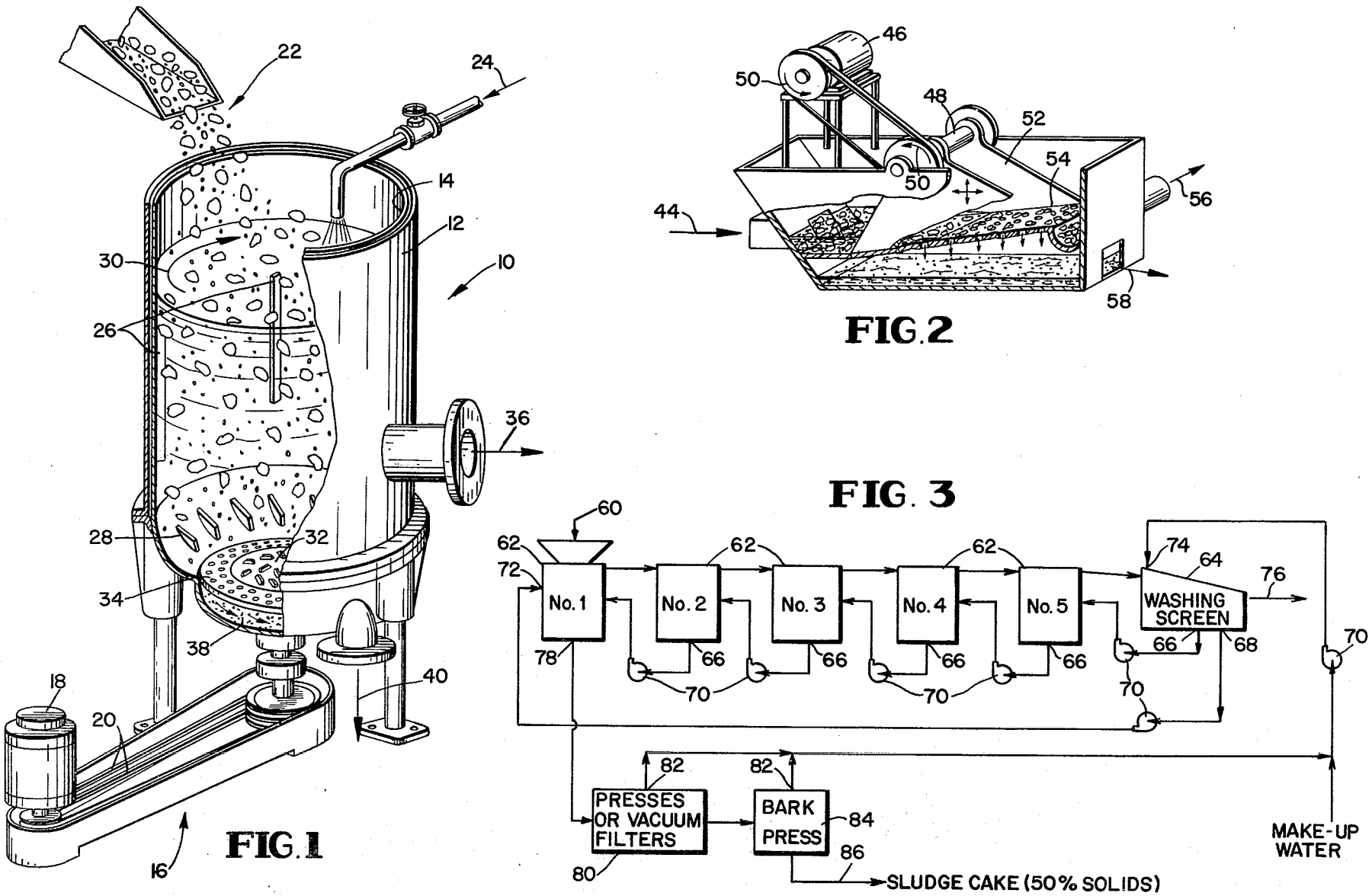
FIG. 1 is a cut-away view of a pulper in which the required vigorous agitation can occur.
FIG. 2 is a cut-away view of a vibrating screen for wet screening the wood mixture from the pulper in order to segregate bark and other contaminants from the wood chips and/or twigs.
FIG. 3 is a diagramatic flowsheet of the preferred embodiment of the invention wherein multiple pulpers are employed in series.

Referring to FIG. 1, the pulper comprises a tank generally designated as 10, comprising a shell having an outside surface 12 and a stationary inside surface 14. A water inlet 24 and a chip mixture inlet 22 are provided at the top of the tank. At the bottom of the tank, agitation means 16 are provided, said means comprising a drive motor 18, a belt 20, a rotor 32, a perforated screen plate 34, fixed deflectors 28, and vertical baffles 26.

In operation, the rotor is driven in direction 30, and fines 38 which pass through the perforated screen plate 34 aare removed with the water through outlet 40. The cellulosic material sufficiently agitated is then withdrawn through outlet 36.

Referring to FIG. 2, the mixture of cellulosic materials and water obtained from the pulper via outlet 36 is passed into the vibrating screen at inlet 44. This vibrating screen comprises an eccentric shaft 48 which is driven by pulleys which are indicated to be turning in directions 50, said pulleys being connected by a belt, and one of said pulleys being driven by drive motor 46. Connected to the eccentric shaft is a vibrating fram 52 which in turn holds inclined perforated screen plate 54. In operation, the bark fines and other contaminants are screened and removed through outlet 58 whereas the wood chips and/or twigs are removed through conduit 56.

With respect to the flowsheet in FIG. 3, the stored chips and/or twigs 60 are passed into pulper 62 (No. 1 pulper). Water 68 is pumped into the pulper at 72 via pump 70. Additional water and bark fines from pulper No. 2 are pumped into pulper No. 1. The wood chips and/or twigs are then passed in sequence to pulpers No. 2, No. 3, No. 4 and No. 5, and the effluent from No. 5 is then passed to the washing screen 64. Withdrawn from the washing screen 64 is a mixture of fines and water 66, and this mixture is then pumped in a countercurrent manner to the wood chips through pulpers No. 5, No. 4, No. 3, No. 2 and No. 1, the bark fines being withdrawn in each case from the bottoms 66 of the pulpers.

The cleaned wood chips and/or twigs are withdrawn from the washing screen at outlet 76. The water fed to the washing screen at 74 is derived from make-up water and also from the water-fines mixture withdrawn from bottom 78 of pulper No. 1 which is then filtered, the residue being fed to a bark press 84, the filtrates from both the filter and the bark press being removed at 82 and recycled to the washing screen 64. The product from the bark press is removed at 86, and is a bark sludge of 50% solids.

DETAILED DISCUSSION

When mixtures of chipped full trees are stored in piles, the mixture in general and the bark in particular gradually decompose. The mechanism of this decomposition is complex and not well understood. Furthermore, while it is not desired to be limited to any particular theory of operation, it is believed that much of it is associated with the activity of certain unidentified microorganisms. Since bark offers a more favorable site than wood for the establishment and support of these organisms, it is affected to a much greater extent by their activity. Typical effects include a significant reduction in the strength of the bond between bark and wood, and a marked decrease in the strength of the bark itself, particularly within the place during decomposition are exothermic and hence, while the surface of these piles may freeze during the winter months, the material within them does not. Decomposition is affected by a number of factors, particularly moisture content, and tends to proceed more rapidly in piles that are sprinkled with water periodically. Chips that have been wetted in this manner over a period of time are readily blended into the rolling flow of a mixing tank and pose no problems in circulation.

The results of laboratory studies indicate that the decomposition of bark can be stimulated in a number of ways, namely:

1. by periodically sprinkling the piles of the chips with water, e.g., for one hour every day; or
2. by steaming the chip mixture prior to conditioning.

When a conditioned mixture of chips, bark, and foliage is agitated vigorously in water, bonded bark is broken free from the chips and is selectively reduced to small-sized particles. A particularly suitable device for this purpose is a conventional pulper, commonly used in the pulp and paper industry to defibre a wide variety of pulps and waste paper. In its most common form, the unit consists of a circular tub with vertical sides. It is equipped with a vaned or lobed rotor, centrally located in the bottom of the tank and surrounded by a flat, annular, perforated screen plate. A suitable motor rotates the rotor at high speed in the horizontal plane. A vortex which develops when the unit is in operation draws the slurry down into the rotor where it is picked up by the vanes and projected outwards against stationary baffles. The baffles direct the flow up the sides of the tank to the surface, where the mixture is once again drawn into the vortex. Fines which pass the screen plate can be bled from the unit while agitation is in progress. The removal and comminution of the bark by defibering action, (such as that provided by the pulper rotor), is essential to the success of the process.

While some breakdown of bark takes place when mixtures are agitated in conventional (low speed) propeller-type, mixing tanks, the effect is generally not pronounced enough to break free the bonded bark from the chips, so that its use is generally not contemplated in the method of this invention.

The method is not affected significantly by the temperature of the water in the pulper, and good results have been obtained with water as cold as 13°C. Similarly, the performance of the unit is not significantly affected by the consistency of the mix, up to a value of about 22 percent. (As used herein, the term "consistency" is defined as follows:

$$\text{Consistency in } \% = \frac{(\text{oven-dry weight of chipped mixture}) \times 100}{(\text{weight of added water} + \text{oven-dry weight of chipped mixture}}$$

At consistencies greater than about 22 percent, the rate of circulation drops and/or flows from around the edge of the pulper and fails to circulate with the rest of the mix. Accordingly, when chips are processed on a batch basis in a pulper, the consistency should not exceed 22 percent. Pulpers can also be operated on a continuous basis, either singly or arranged in series. When a single unit is operated in this manner, the steady flow of chips and water into the unit is matched by an equivalent overflow out of it. In a series arrangement, the overflow from the first unit is the input for the second and so on. In continuous operations, somewhat higher consistencies can be used.

Although most of the breakdown of bark and foliage occurs within the first five minutes of agitation, satisfactory standards of bark removal can generally be achieved after 10 or more minutes, depending on the condition of the mix.

Some breakage of wood occurs along the grain, but never across it. Chips broken in this manner are not splintered, but rather are large enough to be retained on a 3/16 inch perforated screen and as such, are still suitable for pulping.

During agitation in the pulper, bark and foliage are broken down into fragments which will pass through ¼ inch diameter holes in a perforated screen. Conventional dry screening methods cannot be used, however, because of the tendency for this material to adhere to the surface of chips and twigs. Nonetheless, bark and foliage can be segregated from the wood during agitation, by bleeding water continuously from the pulper through an outlet located beneath the screen plate. Alternatively, once the mixture is removed from the pulper, the fines can be washed from the mix by feeding it up to the inclined deck of a partly submerged vibrating screen. With either technique, the material entrained in the effluent is dewatered and recovered in the usual way.

It is preferred that during agitation, that as little water as possible be employed from the standpoint of ecological and economic considerations. A consistency of about 20–22% is especially preferred.

The method can be arranged in several ways and located either at the mill or at a central depot in the forest. In its simplest form and in one preferred embodiment, it consissts of a single pulper operated on a batch basis; conditioned chips are loaded into the unit, agitated for the prescribed length of time, and then flushed from it. During agitation comminuted bark and foliage are drained through the screen plate and out of the pulper. The duration of agitation and the rate at which effluent is drained from the pulper are chosen so that the bark content of the chips flushed from the pulper is not excessive. Alternatively, the fines can be washed through a vibrating screen after the mix is removed from the pulper.

Chipped mixtures can be processed in a continuous manner by arranging several pulpers in series so that the overflow from the first is transferred to the second and so on. As before, bark and foliage can be drained from one, some, or all of the pulpers while agitation is in progress, or during the transfer of the mixture from one pulper to the next. The number and size of the pulpers required vary with the capacity of the installation and the standard of bark removal.

Trials have been run with a 4 ft. diameter by 3 ft. deep Alexander Fleck pulper. The unit was equipped with an 18 inch diameter rotor, driven at 680 rpm by a 20 horsepower motor. All of the following test results were obtained from batch-type trials in which the mixture was agitated for a prescribed length of time in the pulper and then washed on an inclined vibrating screen equipped with ¼ inch diameter holes. In all cases the pulper was run half full, with 62.5 kilograms of chipped mixture (oven-dry basis) added to 272 liters of water (i.e., 18 – 20% consistency). The chipped mixture was prepared from full (complete) black spruce trees, 4 to 5 inches in diameter at breast height. The constituents of the unconditioned, unprocessed mix after chipping are listed in Table I. The data are based on the classification of two 3000 gm., air-dried samples on a Williams classifier.

The invention thus contemplates as a definition of "vigorous agitation" agitation on the order of that obtained with said Alexander Fleck pulper. It will be appreciated, moreover, by those skilled in the art that some routine experimentation will be required to arrive at optimum "vigorous agitation"conditions. Such conditions will be dependent on the type and humidity of the wood chips, the climate and length of time of the conditioning step, and also the time that vigorous agitation is applied. In the final analysis, there is an interrelationship between the extent of partial decomposition in the conditioning step and the required extent of vigorous agitation. The greater the weakening of the bond between the bark and the wood, the lower the amount of vigorous agitation required. It is also apparent moreover that the steps should not be so extreme as to result in a significant reduction in pulp quality. The all important consideration is that based on the knowledge of the feasibility of the present invention, as demonstrated in the following examples, it is then within the skill of those in the art to adapt the invention to particular circumstances.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. In the following examples, all temperatures are set forth uncorrected in degrees Celsius; unless otherwise indicated, all parts and percentages are by weight.

TABLE I

CLASSIFICATION OF CHIPS BEFORE CONDITIONING AND PROCESSING

Constituents of Mixture Expressed as a Percentage of the Sample

| Perforated Screen Size (in.) | Bark Free Wood | | Bonded Wood* | | | Loose Bark | | Bonded Bark | | | Foliage and Cones | Total** |
|---|---|---|---|---|---|---|---|---|---|---|---|---|
| | Chips | Twigs | with Surface Bark | with Edge Bark | Twig Type | Outer | Inner | Surface | Edge | Twig | | |
| Passing 1/8 | 0.5 | — | — | — | — | 0.1 | — | — | — | — | 5.1 | 5.7 |
| Retained on 1/8 | 0.3 | — | — | — | — | 0.3 | T | — | — | — | 0.1 | 0.8 |
| 3/16 | 7.0 | T | 0.1 | 0.2 | 0.1 | 1.1 | 1.0 | 0.1 | 0.1 | 0.1 | 1.5 | 11.3 |
| 3/8 | 19.8 | — | 0.6 | 1.7 | 0.5 | 0.5 | 1.2 | 0.6 | 0.6 | 0.3 | 0.8 | 26.6 |
| 5/8 | 17.0 | — | 0.9 | 2.9 | 0.4 | 0.1 | 0.2 | 0.7 | 0.6 | 0.2 | 0.2 | 23.2 |
| 7/8 | 10.9 | — | 1.0 | 2.8 | 0.3 | — | 0.1 | 0.7 | 0.4 | 0.1 | T | 16.3 |
| 11/8 | 8.3 | — | 1.4 | 4.8 | 0.3 | — | — | 0.9 | 0.3 | 0.1 | — | 16.1 |
| Total** | 63.9 | T | 3.9 | 12.3 | 1.7 | 2.0 | 2.5 | 3.0 | 2.0 | 0.8 | 7.8 | |
| | | | 81.9 | | | | | 18.1 | | | | 100 |

T = Trace, i.e., less than 0.05 percent
*Percentages refer to the wood only, and do not include the bark bounded to it, which is tabulated under "Bonded Bark".
**Totals of columns and rows may not equal the sum of their components, due to rounding.

EXAMPLE 1

Example I provides trials using the mixture in a fresh (unconditioned) state. The results are tabulated in Table II. The mix was agitated for 10 minutes in the pulper. A sample of the "accepts" (i.e., the material retained on the washing screen) was air-dried and classified. Compared to the unprocessed mix (Table I) the overall content of bark and foliage dropped from 17.6 to 8.8 percent, but was still well above the allowable upper limit of 2 percent.

TABLE II

CLASSIFICATION OF UNCONDITIONED CHIPS AFTER 10 MINUTES OF AGITATION IN A PULPER FOLLOWED BY WET SCREENING

Constituents of Mixture Expressed as a Percentage of the Sample

| Perforated Screen Size (in.) | Bark Free Wood | | Bonded Wood* | | | Loose Bark | | Bonded Bark | | | Foliage and Cones | Total** |
|---|---|---|---|---|---|---|---|---|---|---|---|---|
| | Chips | Twigs | with Surface Bark | with Edge Bark | Twig Type | Outer | Inner | Surface | Edge | Twig | | |
| Passing 1/8 | 0.2 | — | — | — | — | T | T | — | — | — | 0.5 | 0.8 |
| Retained on 1/8 | 0.1 | — | — | — | — | T | T | — | — | — | T | 0.3 |
| 3.16 | 12.7 | 0.1 | 0.2 | 0.1 | 0.3 | 0.7 | 2.1 | 2.0 | 0.1 | 0.1 | 0.9 | 17.5 |
| 3/8 | 34.6 | 0.1 | 1.1 | 1.6 | 0.5 | 0.2 | 0.7 | 0.8 | 0.3 | 0.1 | 0.2 | 40.3 |
| 5/8 | 22.0 | 0.1 | 0.9 | 2.2 | 0.3 | — | T | 0.6 | 0.3 | 0.1 | 0.1 | 26.6 |
| 7/8 | 9.0 | — | 0.6 | 0.3 | 0.2 | — | — | 0.4 | T | T | — | 10.7 |
| 11/8 | 2.8 | 0.1 | 0.4 | 0.3 | 0.1 | — | — | 0.1 | T | T | — | 3.9 |
| Total** | 81.5 | 0.5 | 3.3 | 4.5 | 1.4 | 0.9 | 3.0 | 2.1 | 0.7 | 0.3 | 1.7 | |
| | | | 91.2 | | | | | 8.8 | | | | 100. |

T = Trace, i.e., less than 0.05 percent
*Percentages refer to the wood only, and do not include the bark bonded to it, which is tabulated under "Bonded Bark".
**Totals of columns and rows may not equal the sum of their components, due to rounding.

EXAMPLE II

Another trial was run with the same mixture after it was fully conditioned, following 83 days of storage. The results are shown in Table III.

TABLE III

CLASSIFICATION OF WELL CONDITIONED CHIPS (12 WEEKS STORAGE) AFTER 10 MINUTES OF AGITATION IN A PULPER FOLLOWED BY WET SCREENING

Constituents of Mixture Expressed as a Percentage of the Sample

| Perforated Screen Size (in.) | Bark Free Wood | | Bonded Wood* | | | Loose Bark | | Bonded Bark | | | | |
|---|---|---|---|---|---|---|---|---|---|---|---|---|
| | Chips | Twigs | with Surface Bark | with Edge Bark | Twig Type | Outer | Inner | Surface | Edge | Twig | Foliage and Cones | Total** |
| Passing 1/8 | 0.2 | — | — | — | — | — | — | — | — | — | T | 0.2 |
| Retained on | | | | | | | | | | | | |
| 1/8 | 0.1 | — | — | — | — | T | T | — | — | — | — | 0.1 |
| 3/16 | 19.9 | 0.5 | T | T | T | 0.6 | 0.5 | T | T | T | T | 21.6 |
| 3/8 | 49.5 | 0.9 | 0.1 | T | T | 0.1 | 0.2 | T | T | T | T | 50.9 |
| 5/8 | 19.4 | 0.3 | 0.1 | 0.1 | — | — | 0.1 | 0.1 | T | — | — | 20.0 |
| 7/8 | 4.9 | — | T | 0.1 | — | — | — | T | T | — | — | 5.1 |
| 11/8 | 2.1 | — | — | — | — | — | — | — | — | — | — | 2.1 |
| Total** | 96.2 | 1.7 | 0.2 | 0.2 | 0.1 | 0.7 | 0.7 | 0.1 | T | T | T | |
| | | | 98.4 | | | | | 1.6 | | | | 100. |

T = Trace, i.e., less than 0.05 percent

*Percentages refer to the wood only, and do not include the bark bonded to it, which is tabulated under "Bonded Bark".

**Totals of columns and rows may not equal the sum of their components, due to rounding.

The residual bark content of 1.6 percent is within the allowable limit and indicates the importance of conditioning to the success of the process.

The breakage of chips in the process increases with the length of the conditioning period and with the duration of agitation, as shown in Table IV.

data in Tables V, VI, and VII were obtained in trials with a moderately conditioned mixture and indicate the character of the accepts after 5, 10 and 15 minutes of agitation respectively. Most of the breakdown of bark and foliage occurs within the first 5 minutes of agitation, but not enough to satisfy most barking standards.

TABLE IV

THE EFFECTS OF AGITATION AND OF CONDITIONING ON THE BREAKAGE OF BARK FREE CHIPS IN THE PULPER

| Perforated Screen Size (in.) | Percentage Retained on Screen | | | | | |
|---|---|---|---|---|---|---|
| | Cond.: 0 weeks Proc.: 0 mins. | Cond.: 0 weeks Proc.: 10 mins. | Cond.: 6 weeks Proc.: 5 mins. | Cond.: 6 weeks Proc.: 10 mins. | Cond.: 6 weeks Proc.: 15 mins. | Cond.: 12 weeks Proc.: 10 mins. |
| Passing 1/8 | 0.8 | 0.2 | 0.2 | 0.3 | 0.5 | 0.2 |
| Retained on | | | | | | |
| 1/8 | 0.5 | 0.2 | 0.1 | 0.2 | 0.2 | 0.1 |
| 3/16 | 11.0 | 15.6 | 15.7 | 19.5 | 22.2 | 20.7 |
| 3/8 | 31.0 | 42.5 | 45.9 | 46.5 | 50.0 | 51.5 |
| 5/8 | 26.6 | 27.0 | 27.0 | 22.9 | 20.3 | 20.2 |
| 7/8 | 17.1 | 11.1 | 8.3 | 7.3 | 5.6 | 5.1 |
| 1 1/8 | 13.0 | 3.4 | 2.8 | 3.3 | 1.2 | 2.2 |

The amount of agitation required to comminute bark and foliage in a pulper varies with such factors as the size of the pulper and the "condition" of the mix. The In practice, 10 minutes of agitation or more are needed.

TABLE V

CLASSIFICATION OF PARTLY CONDITIONED CHIPS (6 WEEKS STORAGE) AFTER 5 MINUTES OF AGITATION IN A PULPER, FOLLOWED BY WET SCREENING

Constituents of Mixture Expressed as a Percentage of the Sample

| Perforated Screen Size (in.) | Bark Free Wood | | Bonded Wood* | | | Loose Bark | | Bonded Bark | | | | |
|---|---|---|---|---|---|---|---|---|---|---|---|---|
| | Chips | Twigs | with Surface Bark | with Edge Bark | Twig Type | Outer | Inner | Surface | Edge | Twig | Foliage and Cones | Total** |
| Passing 1/8 | 0.2 | — | — | — | — | — | — | — | — | — | — | 0.7 |
| Retained on | | | | | | | | | | | | |
| 1/8 | 0.1 | T | — | — | — | T | T | — | — | — | T | 0.2 |
| 3/16 | 14.7 | 0.4 | T | — | T | 1.4 | 0.5 | T | — | T | 0.1 | 17.2 |
| 3/8 | 42.8 | 0.6 | 0.1 | 0.1 | 0.2 | 0.2 | 0.6 | T | T | T | 0.1 | 44.8 |
| 5/8 | 25.2 | 0.3 | 0.2 | 0.2 | T | — | 0.2 | 0.1 | T | T | T | 26.2 |
| 7/8 | 7.7 | 0.1 | T | 0.1 | — | — | — | T | T | — | — | 8.0 |
| 11/8 | 2.6 | — | 0.3 | — | — | — | — | T | — | — | — | 3.0 |
| Total** | 93.2 | 1.4 | 0.7 | 0.4 | 0.2 | 1.7 | 1.3 | 0.2 | T | 0.1 | 0.7 | |
| | | | 96.0 | | | | | 4.0 | | | | 100. |

= Trace, i.e., less than 0.05 percent

*Percentages refer to the wood only, and do not include the bark bonded to it, which is tabulated under "Bonded Bark".

**Totals of columns and rows may not equal the sum of their components, due to rounding.

TABLE VI

CLASSIFICATION OF PARTLY CONDITIONED CHIPS (6 WEEKS STORAGE) AFTER 10 MINUTES OF AGITATION IN PULPER, FOLLOWED BY WET SCREENING

| Perforated Screen Size (in.) | Constituents of Mixture Expressed as a percentage of the Sample | | | | | | | | | | | |
|---|---|---|---|---|---|---|---|---|---|---|---|---|
| | Bark Free Wood | | Bonded Wood* | | | Loose Bark | | Bonded Bark | | | | |
| | Chips | Twigs | with Surface Bark | with Edge Bark | Twig Type | Outer | Inner | Surface | Edge | Twig | Foliage and Cones | Total** |
| Passing 1/8 | 0.3 | — | — | — | — | — | — | — | — | — | 0.7 | 1.0 |
| Retained on | | | | | | | | | | | | |
| 1/8 | 0.2 | T | — | — | — | 0.1 | 0.1 | — | — | — | — | 0.3 |
| 3/16 | 18.5 | 0.4 | T | T | 0.1 | 0.9 | 0.7 | T | T | T | T | 20.6 |
| 3/8 | 44.1 | 0.4 | T | T | 0.1 | 0.4 | 0.3 | T | T | T | — | 45.4 |
| 5/8 | 21.7 | 0.3 | T | T | 0.1 | 0.1 | T | T | T | T | 0.1 | 22.4 |
| 7/8 | 6.9 | — | 0.1 | — | — | — | — | 0.1 | — | — | — | 7.1 |
| 11/8 | 3.1 | — | — | — | — | — | — | — | — | — | — | 3.1 |
| Total** | 94.8 | 1.1 | 0.2 | 0.1 | 0.3 | 1.4 | 1.1 | 0.1 | T | 0.1 | 0.8 | |
| | | | 96.5 | | | | | 3.5 | | | | 100. |

T = Trace, i.e., less than 0.05 percent
*Percentages refer to the wood only, and do not include the bark bonded to it, which is tabulated under "Bonded Bark".
** Totals of columns and rows may not equal the sum of their components, due to rounding.

TABLE VII

CLASSIFICATION OF PARTLY CONDITIONED CHIPS (6 WEEKS STORAGE) AFTER 15 MINUTES OF AGITATION IN PULPER, FOLLOWED BY WET SCREENING

| Perforated Screen Size (in.) | Constituents of Mixture Expressed as a Percentage of the Sample | | | | | | | | | | | |
|---|---|---|---|---|---|---|---|---|---|---|---|---|
| | Bark Free Wood | | Bonded Wood* | | | Loose Bark | | Bonded Bark | | | | |
| | Chips | Twigs | with Surface Bark | with Edge Bark | Twig Type | Outer | Inner | Surface | Edge | Twig | Foliage and Cones | Total** |
| Passing 1/8 | 0.5 | — | — | — | — | — | — | — | — | — | 0.5 | 0.9 |
| Retained on | | | | | | | | | | | | |
| 1/8 | 0.2 | T | — | — | — | 0.1 | — | — | — | — | T | 0.3 |
| 3/16 | 21.3 | 0.6 | T | — | T | 0.8 | 0.1 | T | — | T | 0.1 | 22.9 |
| 3/8 | 47.8 | 0.7 | 0.1 | T | 0.1 | 0.2 | 0.1 | T | T | T | 0.1 | 49.2 |
| 5/8 | 19.4 | 0.5 | — | — | — | 0.1 | T | — | — | — | 0.1 | 20.1 |
| 7/8 | 5.4 | — | — | — | — | — | — | — | — | — | — | 5.4 |
| 11/8 | 1.2 | — | — | — | — | — | — | — | — | — | — | 1.2 |
| Total** | 95.7 | 1.8 | 0.1 | T | 0.1 | 1.1 | 0.2 | 0.1 | T | T | 0.8 | |
| | | | 97.8 | | | | | 2.2 | | | | 100. |

T = Trace, i.e., less than 0.05 percent
*Percentages refer to the wood only, and do not include the bark bonded to it, which is tabulated under "Bonded Bark".
**Totals of columns and rows may not equal the sum of their components, due to rounding.

Table VIII indicates the wood lost as fines when the chips were washed/screened after agitation and also, the residual bark content of the accepts. Such losses are influenced not only by the lengths of the conditioning and agitation periods, but also by the screening method. Compared to other types of screening equipment, the unit used in these trials incurred relatively high losses and as such, the values shown in Table VIII indicate upper values for the process. Also, it should be noted that the chips were not screened after chipping and hence, some of the wood lost in these trials should be associated with the fines generated when the trees were chipped.

Results similar to those presented in Table III have also been obtained in trials with balsam fir, jack pine, and mixed hardwoods.

TABLE VIII

EFFECTS OF CONDITIONING AND OF AGITATION ON WOOD LOSS AND ON THE BARK CONTENT OF THE ACCEPTS

| | Lenght of Conditioning Period (weeks) | Duration of Agitation (mins.) | Wood Loss (%) | Bark Content (%) |
|---|---|---|---|---|
| Effect of Conditioning | 0 | 10 | 3.0 | 8.8 |
| | 6 | 10 | 4.7 | 3.5 |
| Effect of Duration of | 6 | 5 | 3.8 | 4.0 |
| | 6 | 10 | 4.7 | 3.5 |

TABLE VIII-continued

EFFECTS OF CONDITIONING AND OF AGITATION ON WOOD LOSS AND ON THE BARK CONTENT OF THE ACCEPTS

| | Lenght of Conditioning Period (weeks) | Duration of Agitation (mins.) | Wood Loss (%) | Bark Content (%) |
|---|---|---|---|---|
| Agitation | 6 | 15 | 5.4 | 2.2 |

EXAMPLE III

Kraft and acid sulphite pulps were prepared from wood chips which had been subjected to varying amounts of conditioning in a storage pile (0, 6 and 10 weeks) and agitation in a pulper (0, 5, 10 and 15 minutes). The properties of the kraft pulps are listed in Table IX, while those of the acid sulphite pulps are tabulated in Table X. The method seems to cause a slight reduction in the properties of acid sulphite pulps and has no significant effect on those of kraft pulps.

These results indicate that the method of this invention can be used to separate and segregate bark and foliage from mixtures of full tree chips, to a level satisfactory for pulping and without any significant reduction in pulp quality.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

We claim:

1. A method for detaching bonded bark, and foliage, if present, from wood chips and twigs in a mixture of such components and selectively comminuting and segregating the bark and foliage from said mixture, comprising:

a. storing said mixture in a pile for a sufficient time to effect partial decomposition of the bark and foliage of the mixture to the extent of weakening the bond between the bark and the wood, and the structure within the bark itself;

b. subjecting resultant partially decomposed mixture to vigorous agitation in admixture with sufficient quantity of added water to form a slurry and to allow the mixture to circulate, said vigorous agitation being for a sufficient time to break the bark from the wood chips and twigs and to comminute the bark and foliage to a lower particle size than the wood chips; and c. wet screening the comminuted bark, foliage, and effluent water from the wood chips and twigs of the agitated mixture.

2. The method according to claim 1 wherein said mixture is periodically wetted during said storing of said mixture.

3. The method according to claim 1 wherein said sufficient amount of added water provides a slurry consistency of the mixture of about 20–22%.

4. The method according to claim 1 wherein said mixture is subjected to vigorous agitation for at least 5 minutes.

5. The method according to claim 1 including the additional step of dewatering the screened foliage and bark.

6. The method according to claim 1 wherein the step of breaking the bark from the wood chips and/or twigs and comminuting the bark includes the step of:

rotating the partially decomposed mixture in water by a vaned rotor in a baffled circular enclosure at a speed high enough to cause vortexing of the rotating mixture.

7. The method according to claim 6 wherein said step of rotating includes the step of overflowing said mixture during rotation from said baffled circular enclosure and wherein said method includes the additional step of further rotating said overflowed mixture in at least one additional baffled circular enclosure by a vaned rotor at a speed high enough to cause vortexing of the rotating overflowed mixture.

8. The method according to claim 6 wherein said steps of rotating and wet screening take place simultaneously.

9. The method of claim 8 including the preliminary step of presteaming the mixture before the step of effecting the decomposition of the components of the mixture.

10. The method according to claim 6 wherein said step of wet screening takes place after said step of rotating is completed.

11. The method of claim 10 including the preliminary step of presteaming the mixture before the step of effecting the decomposition of the components of the mixture.

12. The method according to claim 1 including the preliminary step of presteaming the mixture before the step of effecting the decomposition of the components of the mixture.

13. A method according to claim 1 wherein:

the storing is conducted for 3 – 18 weeks;

the vigorous agitation and wet screening steps are conducted concurrently in at least one pulper comprising an open top container equipped with means for accomplishing the vigorous agitation of slurrys, and provided with a screening plate set over an outlet in either a side or the bottom of the container, said mixture during said vigorous agitation having a consistency not exceeding 22%.

14. The method according to claim 13 including the additional step of dewatering the screened foliage and bark.

15. The method according to claim 13 wherein said means for accomplishing vigorous agitation comprises a vaned rotor in a baffled circular enclosure and provided with sufficient power to permit a speed high enough to cause vortexing of the mixture.

16. A method according to claim 13 conducted in continuous manner in a plurality of serially connected pulpers.

17. The method according to claim 13 including the preliminary step of presteaming the mixture before the step of effecting the decomposition of the components of the mixture.

* * * * *

UNITED STATES PATENT OFFICE

CERTIFICATE OF CORRECTION

Patent No. 3,981,453 Dated September 21, 1976

Inventor(s) Robin Wilfrid Berlyn et al.

It is certified that error appears in the above-identified patent and that said Letters Patent are hereby corrected as shown below:

Column 12, Example III, after line 66, insert the attached Tables IX and X, respectively.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*

TABLE IX. Properties of Kraft Pulps Prepared from Wood Chips Conditioned in a Chip Pile and Agitated in a Pulper for Various Lengths of Time

| Treatment | | | | | Properties | | | | | | | | | | | | | | | |
|---|---|---|---|---|---|---|---|---|---|---|---|---|---|---|---|---|---|---|---|---|
| Condi-tioning (weeks) | Proc-essing (mins.) | Sample No. | Kappa No. | Yield No. | Bulk cc/gm | (%)* | Burst Factor | (%) | Tear Factor | (%) | Breaking Length (m.) | (%) | Stretch (%) | (%) | Toughness Factor | (%) | MIT Double Folds | (%) | Brightness | (%) |
| C.S. Freeness 500 | | | | | | | | | | | | | | | | | | | | |
| 0 | 0 | 1 | 24.9 | 45.9 | 1.37 | | 116.6 | | 117 | | 14013 | | 3.94 | | 3103 | | 3107 | | 20.9 | |
| 0 | 10 | 2 | 25.2 | 47.0 | 1.35 | -1.5 | 115.3 | -1.1 | 117 | 0. | 13842 | -1.2 | 3.82 | -3.0 | 3108 | +0.2 | 2349 | -24.4 | 20.5 | -1.9 |
| 10 | 0 | 3 | 24.9 | 47.3 | 1.38 | +0.7 | 114.5 | -1.8 | 119 | +1.7 | 13865 | -1.1 | 3.77 | -4.3 | 2900 | -6.5 | 2665 | -14.2 | 21.4 | +2.4 |
| 6 | 5 | 4 | 23.9 | 47.1 | 1.38 | +0.7 | 119.4 | +2.4 | 115 | -1.7 | 14156 | +1.0 | 3.81 | -3.3 | 2917 | -6.0 | 2897 | - 6.7 | 21.4 | +2.4 |
| 6 | 10 | 5 | 24.1 | 47.6 | 1.41 | +2.9 | 111.0 | -4.8 | 120 | +2.6 | 12872 | -8.1 | 3.47 | -11.9 | 2398 | -22.7 | 2982 | - 4.0 | 20.4 | -2.4 |
| 6 | 15 | 6 | 24.2 | 44.7 | 1.39 | +1.5 | 113.2 | -2.9 | 115 | -1.7 | 13424 | -4.2 | 3.69 | -6.3 | 2654 | -14.5 | 2343 | -24.6 | 20.9 | 0 |
| C.S. Freeness 300 | | | | | | | | | | | | | | | | | | | | |
| 0 | 0 | 1 | 24.9 | 45.9 | 1.33 | | 121.5 | | 117 | | 14362 | | 4.25 | | 3459 | | 2103 | | 19.9 | |
| 0 | 10 | 2 | 25.2 | 47.0 | 1.33 | 0 | 120.4 | -0.9 | 105 | -10.3 | 14060 | -2.1 | 4.08 | -4.0 | 3188 | -7.8 | 3048 | +44.9 | 19.5 | -2.0 |
| 10 | 0 | 3 | 24.9 | 47.3 | 1.33 | 0 | 122.1 | +0.5 | 110 | - 6.0 | 13837 | -3.7 | 3.94 | -7.3 | 2997 | -13.3 | 4280 | +103.5 | 20.2 | +1.5 |
| 6 | 5 | 4 | 23.9 | 47.1 | 1.36 | +2.3 | 123.4 | +1.6 | 105 | -10.3 | 14984 | +4.3 | 4.08 | -4.0 | 3399 | -1.7 | 3357 | +59.6 | 20.6 | +3.5 |
| 6 | 10 | 5 | 24.1 | 47.6 | 1.35 | +1.5 | 125.9 | +3.6 | 120 | + 2.6 | 14063 | -2.1 | 3.83 | -9.9 | 2936 | -15.1 | 3355 | +59.5 | 19.7 | -1.0 |
| 6 | 15 | 6 | 24.2 | 44.7 | 1.34 | +0.7 | 114.4 | -5.8 | 122 | + 4.3 | 14027 | -2.3 | 3.93 | -7.5 | 3032 | -12.3 | 2791 | +32.7 | 19.8 | -0.5 |

* % = Percentage difference as compared to the "control" value (i.e. Conditioned 0 Weeks, Processed 0 mins.)

TABLE X. Properties of Acid Sulphite Pulps Prepared from Wood Chips Conditioned in a Chip Pile and Agitated in a Pulper for Various Lengths of Time

| Treatment | | | | | Properties | | | | | | | | | | | | | | | |
|---|---|---|---|---|---|---|---|---|---|---|---|---|---|---|---|---|---|---|---|---|
| Conditioning (weeks) | Processing (mins.) | Sample No. | Kappa No. | Yield No. | Bulk cc/gm | (%)* | Burst Factor | (%) | Tear Factor | (%) | Breaking Length (m.) | (%) | Stretch (%) | (%) | Toughness Factor | (%) | MIT Double Folds | (%) | Brightness | (%) |
| C.S. Freeness 500 | | | | | | | | | | | | | | | | | | | | |
| 0 | 0 | 1 | 29.9 | 48.5 | 1.30 | | 89.1 | | 75. | | 11616 | | 3.56 | | 2296 | | 1418 | | 40.7 | |
| 0 | 10 | 2 | 29.3 | 50.3 | 1.31 | +0.7 | 76.9 | -13.7 | 79. | + 5.3 | 10099 | -13.1 | 3.09 | -13.2 | 1742 | -24.1 | 1617 | +14.0 | 42.7 | +4.9 |
| 10 | 0 | 3 | 28.4 | 45.5 | 1.33 | +2.3 | 90.4 | + 1.5 | 83. | +10.7 | 11671 | +0.5 | 3.46 | -2.8 | 2198 | - 4.3 | 1921 | +35.5 | 40.9 | +0.5 |
| 6 | 5 | 4 | 29.1 | 48.2 | 1.32 | +1.5 | 80.4 | - 9.8 | 74. | - 1.3 | 10505 | -9.6 | 3.20 | -10.1 | 1842 | -19.8 | 1357 | - 4.3 | 41.5 | +2.0 |
| 6 | 10 | 5 | 28.9 | 48.6 | 1.34 | +3.1 | 81.1 | - 9.0 | 75. | 0. | 10941 | -5.8 | 3.09 | -13.2 | 1834 | -20.1 | 1579 | +11.3 | 40.0 | -1.7 |
| 6 | 15 | 6 | 28.9 | 49.2 | 1.29 | -0.8 | 73.7 | -17.3 | 73. | - 2.7 | 10321 | -11.1 | 3.12 | -12.3 | 1806 | -21.3 | 1391 | - 1.9 | 39.9 | -2.0 |
| C.S. Freeness 300 | | | | | | | | | | | | | | | | | | | | |
| 0 | 0 | 1 | 29.9 | 48.5 | 1.27 | | 91.1 | | 78. | | 11879 | | 3.82 | | 2482 | | 2237 | | 38.3 | |
| 0 | 10 | 2 | 29.3 | 50.3 | 1.28 | +0.8 | 84.1 | - 7.7 | 79. | + 1.3 | 11719 | -1.3 | 3.46 | -9.4 | 2044 | -17.6 | 1182 | -47.[illegible] | 42.2 | +10.2 |
| 10 | 0 | 3 | 28.4 | 45.5 | 1.22 | -3.9 | 77.5 | -14.9 | 79. | + 1.3 | 9207 | -22.5 | 3.24 | -15.2 | 1779 | -28.3 | 1380 | -38.3 | 39.0 | + 1.8 |
| 6 | 5 | 4 | 29.1 | 48.2 | 1.28 | +0.8 | 87.0 | - 4.5 | 71. | - 9.0 | 11298 | -4.9 | 3.60 | -5.7 | 2213 | -10.8 | 1806 | -19.3 | 38.3 | 0 |
| 6 | 10 | 5 | 28.9 | 48.6 | 1.31 | +3.1 | 82.1 | - 9.9 | 73. | - 6.4 | 11147 | -6.2 | 3.30 | -13.6 | 1994 | -19.7 | 2242 | + 0.2 | 37.8 | - 1.3 |
| 6 | 15 | 6 | 28.9 | 49.2 | 1.25 | -1.6 | 74.8 | -17.9 | 72. | - 7.7 | 10552 | -11.[illegible] | 3.50 | -8.4 | 2140 | -13.8 | 1788 | -20.1 | 37.4 | - 2.3 |

* % = Percentage difference as compared to the "control" value (i.e. Conditioned 0 weeks, Processed 0 mins.)